US005297293A

United States Patent [19]

Obujen

[11] Patent Number: 5,297,293

[45] Date of Patent: Mar. 29, 1994

[54] PROTECTIVE DEVICE

[76] Inventor: Douglas M. Obujen, P.O. Box 160446, Cupertina, Calif. 95014

[21] Appl. No.: 943,314

[22] Filed: Sep. 10, 1992

[51] Int. Cl.[5] ..... A41D 13/00

[52] U.S. Cl. ..... 2/2; 2/267; 2/44; 2/901

[58] Field of Search ..... 2/2, 2.5, 16, 44, 45, 2/22, DIG. 7, 267, 268; 5/481, 653, 643, 901; 206/591, 594, 521; 36/29; 128/845, 60, 62 R; 428/161, 162, 163, 164, 165, 171, 172, 173, 178, 304.4, 166

[56] References Cited

U.S. PATENT DOCUMENTS

| | | | |
|---|---|---|---|
| 1,587,946 | 6/1926 | Gibson | 2/2 |
| 2,249,966 | 7/1941 | Matthews | 2/2 |
| 3,049,736 | 8/1962 | Toulmin, Jr. | 2/2 |
| 3,577,985 | 5/1971 | Guffin | 128/62 R |
| 3,945,042 | 3/1976 | Lobo | 2/2 |
| 4,047,254 | 9/1977 | Hamasu | 5/481 |
| 4,472,472 | 9/1984 | Schultz . | |
| 4,538,301 | 9/1985 | Sawatzki et al. . | |
| 4,593,482 | 6/1986 | Mayer | 36/29 |
| 4,881,529 | 11/1989 | Santos | 2/2 |
| 4,914,836 | 4/1990 | Horovitz | 36/29 |
| 4,985,931 | 1/1991 | Wingo, Jr. . | |
| 5,117,566 | 6/1992 | Lloyd et al. | 36/29 |

FOREIGN PATENT DOCUMENTS

| | | | |
|---|---|---|---|
| 155669 | 12/1904 | Fed. Rep. of Germany | 2/2.5 |
| 670413 | 1/1939 | Fed. Rep. of Germany | 2/2 |
| 18478 | 9/1901 | United Kingdom | 36/29 |

*Primary Examiner*—Clifford D. Crowder
*Assistant Examiner*—Gloria Hale
*Attorney, Agent, or Firm*—Limbach & Limbach; George C. Limbach

[57] ABSTRACT

A pelvic protective device is disclosed including a foam padding member having a plurality of spaced apart ridges on opposite broad surfaces thereof and forming valleys between the ridges and with the ridges on one of the broad surfaces being aligned with the valleys on the other of the broad surfaces. A plurality of flexible tubular elements are fixedly secured to the padding member in the valleys between the ridges. The tubular elements, and particularly at least ½ thereof, project above the ridges, and the tubular elements have a ratio of the thickness of the tubular element to the outside diameter of the tubular elements of substantially 1 to 7.

13 Claims, 1 Drawing Sheet

PROTECTIVE DEVICE

FIELD OF THE INVENTION

The present invention relates in general to a protective device and more particularly to a protective device for a serving as a pelvic protector.

BACKGROUND OF THE INVENTION

Many different types of protective devices have been used for protecting various parts of the human body to protect against impacts which occur in various activities, particularly in sports activities. The recent development of in-line skates has emphasized the need for protective devices for knees, hands, elbows and heads. Many old style protective devices have been utilized as well as improved upon for protecting these vulnerable portions of the body. The expanded use of in-line skates has emphasized the need for an effective, light weight, comfortable and inexpensive protective device, especially useful for protecting the pelvic region.

U.S. Pat. Nos. 4,472,472, 4,538,301, 4,881,529 and 4,985,931 describe and illustrate a number of different forms of protective devices. However, the construction of these devices does not provide the form of light weight, comfortable yet inexpensive protective device that will protect against impact incurred when a body falls going at vastly different velocities as provided for by the present invention.

SUMMARY OF THE INVENTION

Broadly stated the present invention, to be described in greater detail below, is directed to a protective device especially for the pelvic region which includes a foam padding member having a plurality of spaced apart ridges on at least one broad surface thereof and a plurality of flexible tubular elements fixedly secured to the padding member in between the ridges.

Features of the present invention are the provision of a small light weight protective device capable of effectively cushioning body impacts resulting from falls at various speeds while remaining comfortable and inexpensive to manufacture.

Another aspect of the present invention is the provision of a plurality of spaced apart ridges on opposite broad surfaces of the padding member and forming valleys between the ridges with the ridges on one of the broad surfaces being aligned with the tubular elements in the valleys on the other broad surface.

A feature and advantage of the last aforementioned aspect of the present invention is the alignment of the tubular elements positioned on one side of the member with ridges on the opposite side of the member providing a high degree of variable compression from the combination of the aligned foam padding ridges and tubular members on opposite sides of the device for cushioning against impact in falls over a wide velocity range.

Another aspect of the present invention is the provision of tubular elements in the valleys between the ridges and projecting above the tops of the ridges therebetween. In the preferred embodiment one-half of each of the tubes projects above the ridges of the padding member.

In accordance with another aspect of the present invention the ratio of the thickness of the tubular elements to the outside diameter of the tubular elements is substantially 1 to 7.

In accordance with the last aforementioned features of the present invention, the combination of the size and shape of the tubular elements with respect to the ridges and valleys of the foam padding member are believed to provide protection against both light and heavy impacts resulting from a person falling while traveling at widely divergent speeds.

Other features and advantages of the present invention will become more apparent on a perusal of the following specification taken in conjunction with the accompanying drawings wherein similar characters of reference refer to similar structure in each of the separate views.

DESCRIPTION OF THE PREFERRED EMBODIMENTS

Figure 1:
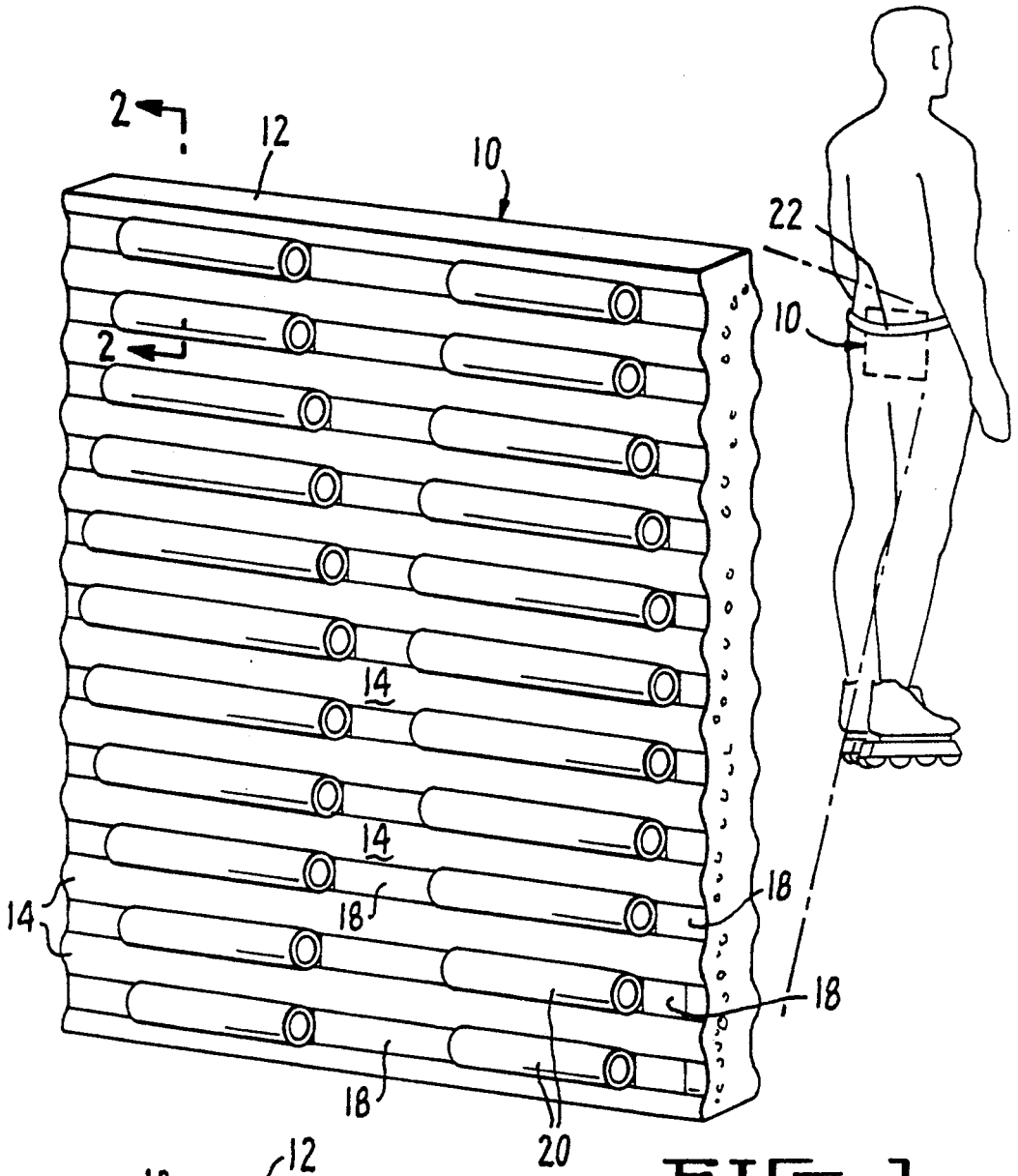
FIG. 1 is a schematic, exploded perspective view of the preferred embodiment of the present invention and its preferred position on the body.

While it will be appreciated that the present invention is equally applicable to the construction of a protective device for various different parts of the body, the preferred embodiment is directed to a pelvic protective device which protects primarily the pelvic regions during falls and at the same time protects the tail bone.

Referring now to the drawing the pelvic protective device 10 in accordance with the present invention includes a foam padding member 12 which has a plurality of substantially equally spaced apart ridges 14 which form valleys 16 therebetween arranged on opposite surfaces of the foam padding member 12 and with the ridges 14 on one of the broad surfaces being aligned with the valleys 16 on the other of the broad surfaces. The foam padding member 12 includes regions 18 along the opposite side edges thereof and down the middle therebetween interrupting the valleys 16 extending laterally of the protective device 10 into 2 spaced apart series of valleys 16.

Figure 2:
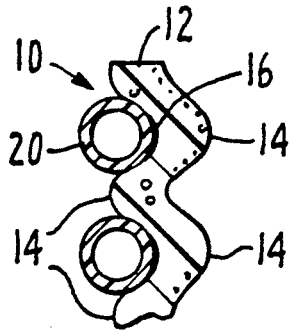
FIG. 2 is a elevational sectional view of a portion of the structure shown in FIG. 1 taken a long lines 2—2 in the direction of the arrows.

A plurality of flexible, yet substantially rigid tubular elements 20 are fixedly secured such as by cementing, to the padding member 12 in the valleys 16. As best shown in FIG. 2, substantially ½ of each of the tubular elements 20 projects above the tops of the adjacent ridges 14.

In accordance with the preferred embodiment the tubular elements 20 are formed of thick-walled polyvinyl tubing such as having an outside diameter of 7/16 inch and a wall thickness of 1/16 inch whereby the ratio of the thickness of the tubular elements to the outside diameter of the tubular elements is substantially 1 to 7. In the preferred embodiment shown in FIGS. 1–2 the foam pad between opposed surfaces in regions 18 is substantially ½ inch thick with the total thickness from the plane of the tops of the ridges 14 on one surface to the plane of the tops of the ridges 14 on the opposite broad surface being ¾ inch. The resulting thickness from the top of the ridge 14 on one broad surface to the top of the tubular element 20 on the opposite side of the pad is 7/16 inch.

The protective device made for an average size individual is approximately 6 inches wide and 9 inches long and contains two rows of tubular elements 20 varying in length from 1½ inch to 3 inch arranged in two parallel rows of 11 tubes each. The foam padding member 12 is conveniently made from foam padding sold as a camping mattress by Cascade Design, Inc. of Seattle, Wash. under the designation "RIDGEREST".

The pelvic protection device is easily worn by being positioned underneath the waistband 22 of the wearer's garment with the tubular elements projecting outwardly whereby the pelvic region and tail bone of the wearer are protected by the device.

It will be apparent that the protective device of the present invention may be made in other forms especially applicable for other parts of the body.

While the preferred embodiment of the present invention has been described and illustrated, it will be appreciated by persons skilled in the art that various modification can be made to the illustrated embodiments without departing from the scope of the invention described and claimed herein. For example, a second covering layer of uniform thickness flat material or conforming to the ridges and valleys of the foam padding member 12 can be provided over the exposed surface of the tubular elements 20.

The terms and expression which have been employed here are used as terms of description and not of limitation, and there is no intention, in the use of such terms and expressions, of excluding equivalence of the features shown and described or portions thereof, it being recognized that various modifications are possible within the scope of the invention claimed.

Claims:

1. A protective device comprising, in combination:

a foam padding member having a plurality of spaced apart ridges having tops on at least one broad surface thereof, and a plurality of flexible tubular elements fixedly secured to said padding member in between the ridges thereof whereby the protective device worn on the human body cushions impact over a wide force range while remain comfortable for active movement of the human body.

2. The protective device of claim 1 wherein said foam padding member includes opposite broad surfaces each having valleys in between said ridges with the ridges on one of said broad surfaces being aligned with the valleys on the other of said broad surfaces.

3. The protective device of claim 1 wherein said tubular elements project above the tops of said ridges.

4. The protective device of claim 3 wherein substantially half of the diameter of said tubes projects above the tops of said ridges.

5. The protective device of claim 1 wherein the ratio of the thickness of said tubular elements to the outside diameter of said tubular elements is substantially 1 to 7.

6. The protective device of claim 1 serving as a pelvic protection device and including at least one pair of spaced apart rows of said tubular elements secured to said foam padding member.

7. The protective device of claim 2 wherein said tubular elements project above the tops of the adjacent ridges.

8. A protective device comprising, in combination, a foam padding member having a plurality of spaced apart ridges on opposite broad surfaces thereof said ridges having to and forming valleys between said ridges, the ridges on one broad surface of said padding member being aligned with the valleys on the other broad surface of said padding member, and a plurality of flexible tubular elements fixedly secured to at least one of said broad surface of said padding member in the valleys between said ridges.

9. The protective device of claim 8 wherein said tubular elements project above the tops of said ridges.

10. The protective device of claim 9 wherein substantially half of the diameter of said tubes projects above the tops of said ridges.

11. The protective device of claim 8 wherein the ratio of the thickness of said tubular elements to the outside diameter of said tubular elements is substantially 1 to 7.

12. The protective device of claim 8 serving as a pelvic protection device and including at least one pair of spaced apart rows of said tubular elements secured to said foam padding member.

13. The protective device of claim 10 wherein said tubular elements project above the tops of the adjacent ridges.

* * * * *